United States Patent [19]

Deutsch

[11] 4,108,039

[45] Aug. 22, 1978

[54] SWITCH SELECTABLE HARMONIC STRENGTH CONTROL FOR A TONE SYNTHESIZER

[75] Inventor: Ralph Deutsch, Sherman Oaks, Calif.

[73] Assignee: Kawai Musical Instrument Mfg. Co., Ltd., Hamamatsu, Japan

[21] Appl. No.: 712,737

[22] Filed: Aug. 9, 1976

[51] Int. Cl.[2] ..... G10H 1/02

[52] U.S. Cl. ..... 84/1.19; 84/1.01

[58] Field of Search ..... 84/453, 1.01, 1.03, 84/1.11, 1.12, 1.19, 1.22, 1.23, DIG. 22

[56] References Cited

U.S. PATENT DOCUMENTS

| | | | |
|---|---|---|---|
| 3,610,799 | 10/1971 | Watson | 84/1.01 |
| 3,727,510 | 4/1973 | Cook, Sr. | 84/453 |
| 3,755,609 | 8/1973 | Millet et al. | 84/1.23 |
| 3,757,023 | 9/1973 | Peterson | 84/1.11 |
| 3,809,786 | 5/1974 | Deutsch | 84/1.01 |
| 3,809,790 | 5/1974 | Deutsch | 84/1.23 |
| 3,913,442 | 10/1975 | Deutsch | 84/1.19 |
| 3,935,781 | 2/1976 | Katoh et al. | 84/1.11 |
| 3,992,971 | 11/1976 | Chibana et al. | 84/1.11 |

*Primary Examiner*—Gene Z. Rubinson
*Assistant Examiner*—Vit W. Miska
*Attorney, Agent, or Firm*—Christie, Parker & Hale

[57] ABSTRACT

A digital computer organ in which individual tones are generated by calculating digital data corresponding to the amplitudes of a plurality of sample points within each cycle of the waveform of a selected tone by summing for each point the product of a digitally stored coefficient value and a sine value for each of a predetermined number of harmonics. An addressable memory stores at least one set of digitally coded coefficient values. A coefficient value is read out of the memory for each calculation. The addressing of coefficient values in the memory is under the control of a plurality of multipole switches in the form of drawbars, each position of a drawbar corresponding to an address location in the memory. The drawbars are activated in sequence so that each one selects in sequence the next coefficient value read out of memory according to the setting of the drawbar.

6 Claims, 1 Drawing Figure

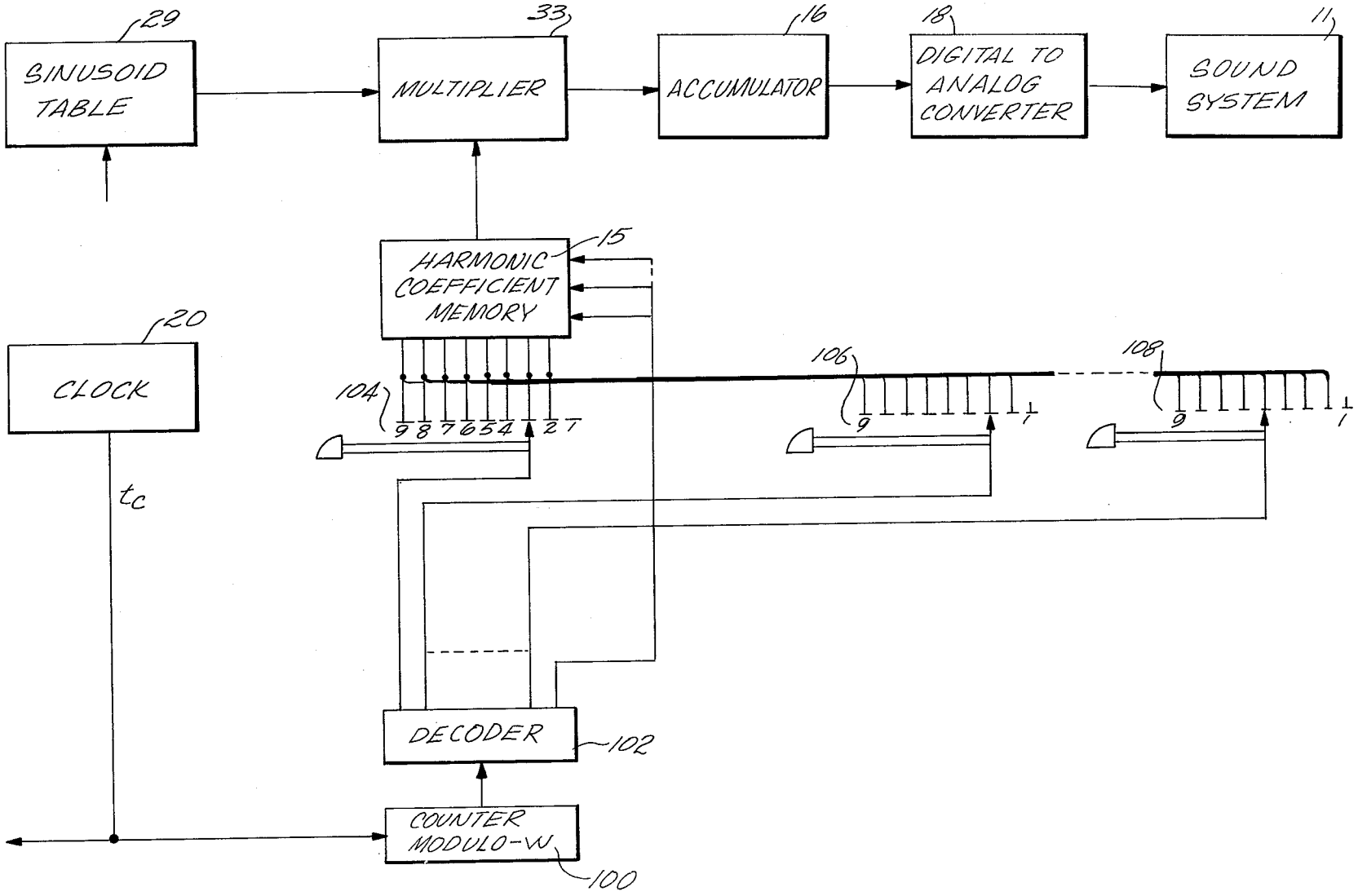
SOUND SYSTEM
11
DIGITAL TO ANALOG CONVERTER
18
ACCUMULATOR
16
MULTIPLIER
33
SINUSOID TABLE
29
HARMONIC COEFFICIENT MEMORY
15
CLOCK
20
tc
DECODER
102
COUNTER MODULO-W
100
108
106
104

SWITCH SELECTABLE HARMONIC STRENGTH CONTROL FOR A TONE SYNTHESIZER

FIELD OF THE INVENTION

This invention relates to digital electronic musical instruments, and more particularly, to a drawbar controlled digital type tone synthesizer.

BACKGROUND OF THE INVENTION

With the development of the electronic organ the capability of synthesizing a wide range of musical tones was made possible. Conventional electronic organs utilize a plurality of oscillators which generate sinusoidal tones at the fundamental frequency corresponding to the pitch of each note of an equal tempered scale. The outputs of the oscillators can be mixed with appropriate overtones to produce different musical sounds having complex waveforms. In at least one well known electronic organ this mixing of overtones was accomplished by means of a set of manually operated drawbars. Each drawbar selected a particular overtone and the position of the drawbar determined the relative amplitude of the selected overtone. The number of tone variations which could be selected corresponded to the product of the number of drawbars and the number of settable positions of each of the drawbars. Since the drawbars selected signals from the oscillators which generated the fundamental frequencies for the various notes in the tempered scale, the resulting overtones added by the drawbars were not true harmonics, thereby resulting in some dissonances of sound.

In my U.S. Pat. No. 3,809,786 there is described an electronic organ in which the waveform for each tone is digitally computed in real time. The amplitude of successive sample points of a complex wave shape corresponding to the selected note and tonal value are calculated by adding the amplitudes of a plurality of harmonics. The relative amplitude of each harmonic is determined by a harmonic coefficient, the coefficient values for all the harmonics being stored digitally in a harmonic coefficient memory. The coefficient values determine the relative amplitude of the sine wave harmonic components of the tone being synthesized. By selecting different coefficient values, the waveform of the tone being synthesized by the computational process described in the patent can be varied. The tonal value of the note can be selected by providing a plurality of "stops," each stop selecting a different set of coefficient values. However, this arrangement requries a separate set of coefficient values for each stop tab on the organ, which greatly limits the number of different quality tones which can be generated. Also, a large amount of memory is required to store a different set of coefficients for each tone that can be synthesized.

In my patent application Ser. No. 603,776, filed Aug. 11, 1975, entitled "Polyphonic Tone Synthesizer," now issued as U.S. Pat. No. 4,085,644 there is also described a digital device for calculating complex waveforms for synthesizing different quality tones. The musical instrument described in the copending application, in contrast to that described in the patent, does not require computation in real time. However, it does compute during a compute cycle the point-by-point variations in amplitude of a complex waveform by summing the relative amplitudes of a plurality of harmonic components of the waveform. A set of harmonic coefficients are stored in a harmonic coefficient memory in a manner similar to the harmonic coefficient memory of the above-identified patent.

SUMMARY OF THE INVENTION

The present invention is directed to an improved tone synthesizer of the types described in my earlier patent and copending application in which digitized data representing the point-by-point amplitude variations of a complex waveform are calculated by adding the amplitudes of a plurality of harmonics defined by the product of a coefficient and a sine function. Specifically, the present invention is directed to an arrangement by which a plurality of manually-operated multipole switches, preferably in the form of drawbars common to electronic organs, are used to control the wave shape of a digitally synthesized tone. The switches control the selective addressing of coefficient values in memory for each harmonic used in the calculation of the waveform data. The coefficient values may be selected to permit the switches to vary the strength of certain selected harmonics in a manner which simulates the mixing of overtones of different strength in the earlier conventional electronic organ, duplicating for the musician the effects learned with conventional electronic organs, but the harmonic coefficient values can be established according to any desired criteria to achieve the synthesis of particular tone values. Moreover, the added overtones controlled by the drawbars are true harmonics, giving a much more pleasing audio effect.

In brief, the present invention is directed to an improvement in digital computer organs in which individual tones are generated in response to digital data corresponding to the amplitudes of a plurality of points of a waveform of a selected tone and calculated by summing for each point the product of a digitally stored coefficient value and a sine value of a predetermined number of harmonics. The present invention provides apparatus for preselecting the tonal quality by selectively modifying the calculated data using a plurality of manually-operated multipole switches preferably in the form of drawbars which are used to control the addressing of coefficient values stored in an addressable memory. The individual setting of each switch selects a particular address in memory where a coefficient value is stored. Sequential addressing of the coefficient values is provided by sequentially activating each of the switches. As each coefficient is read out of memory it is used to calculate the relative amplitude at the sample point for one harmonic. Thus each switch operates to select a harmonic coefficient from memory for a particular harmonic component of the tone being synthesized and the setting of the switch determines the relative strength of that component by controlling the address location of the coefficient read out of memory.

DESCRIPTION OF THE DRAWINGS

For a more complete understanding of the invention reference should be made to the accompanying drawing, wherein the single FIGURE is a schematic block diagram of a portion of a tone synthesizer incorporating the features of the present invention.

DETAILED DESCRIPTION

Referring to the drawing, the block diagram as shown and as hereinafter described, is shown as a modification to the computer organ shown and described in U.S. Pat. No. 3,809,786 which is hereby incorporated by reference. Portions of the present circuit shown in the drawing which correspond identically to portions of the circuit shown in the patent have the corresponding reference numbers.

The computer organ described in the patent digitally calculates the amplitude of a plurality of sample points on the desired waveform. These digitized sample points are then applied to a digital-to-analog converter to generate the waveform in analog form as an electrical signal for driving a sound system. The point-by-point digital computations utilize the sine values for a predetermined number of harmonics stored in a sinusoid table 29. A selected sine value is applied to one input of the multiplier 33 from the table 29 with each clock pulse $t_c$ from a clock source 20. At the same time a coefficient value is applied to a second input of the multiplier 33 from a harmonic coefficient memory 15. The digital output of the multiplier 33 corresponds to the relative amplitude of one harmonic at one sample point. Successive outputs from the multiplier 33 correspond to the amplitudes of a succession of the different harmonics at the same sample point which are added in an accumulator 16 and applied to a digital-to-analog converter 18, the output of which drives a sound system 11, all in the manner described in detail in the above-identified patent. The calculation is repeated at each successive sample point by using different values from the table 29 but repeating the same coefficient value for each harmonic from the coefficient memory 15.

As described in the above-identified patent, different tones can be synthesized by changing the values of the coefficients for each harmonic. This was accomplished, according to the teaching of the patent, by providing a plurality of harmonic coefficient memories 15A, 15B, etc., each memory storing a different set of coefficient values. Stop tabs on the organ selected which of the memories and hence which set of coefficient values were used in computing the waveform of a selected tone.

The present invention is directed to an improvement which allows greater flexibility in tone control. This is accomplished within a computer organ of the type described in the above-identified patent by utilizing a harmonic coefficient memory 15 in which the coefficients are stored in individually addressable locations in memory. Thus the memory 15 may comprise a plurality of separate registers, each register storing a predetermined coefficient value. The contents of each register, in response to an input associated with that register, transfers the contents of the addressed register to the output of the memory. Thus the harmonic coefficient memory 15 has one address input for each register in the memory. Preferably the memory 15 has one register for each harmonic, although more than one register may be provided, as hereinafter explained. The harmonic coefficient memory 15 is addressed by a counter 100 which is advanced by the clock source 20. The modulo of the counter 100 corresponds to the number W of harmonic components being evaluated. If the counter 100 is a binary counter, the binary states are applied to a decoder 102 which provides an output signal on one of W output lines in response to the count condition of the counter 100. If a ring counter is used for the counter 100, the decoder 102 of course is not necessary.

The output lines from the decoder 102 are used to address the harmonic coefficient memory 15 through a plurality of drawbar switches, three of which are indicated at 104, 106, and 108. There may be any number of drawbar switches up to the maximum number of harmonic components W, each drawbar switch being associated with one harmonic. However, the number of drawbars is preferably less, for example nine in number, and assigned to the first, second, third, fourth, fifth, sixth, and eighth harmonics of the 8′ stop and 1st and 3rd harmonics of the 16′ stop. Each drawbar switch has a plurality of poles, nine poles being shown by way of example. Eight of the poles are connected respectively to eight of the register selecting (or addressing) inputs of the memory 15. The poles of the several drawbar switches are preferably connected in parallel.

As noted above, the number of drawbars may be less than the number of harmonics so that only selected ones of the harmonics may be modified in strength by an associated drawbar switch. Coefficients for the remaining harmonics may be directly addressed by fixed wiring between the decoder 102 and the memory 15. While the drawbars are shown with their poles connected in parallel so that each drawbar addresses the same table of coefficients in the memory 15, it will be evident that, by using a larger memory, each drawbar may address an individual table of coefficients in memory.

In operation, as the counter 100 is advanced by the clock pulse $t_c$ the decoder 102 successively activates each output line. Each of these output lines in turn activates the input to an associated one of the drawbar switches. Depending on the setting of the associated drawbar switches, the coefficients stored in selected ones of the registers of the memory 15 are transferred to the multiplier 33 successively with each clock pulse $t_c$. Each coefficient value is transferred to the multiplier 33 where it is multiplied with the sine function of the corresponding harmonics to provide an amplitude value for each harmonic at one sample point. The amplitude values are summed in an accumulator 16 to produce a digitized composite amplitude for all harmonics at the sample point. Resultant amplitude value is converted to a voltage level by a digital-to-analog converter 18. This operation is repeated for each sample point, generating a succession of output voltages corresponding to the sample points of the waveform. After filtering the resultant signal drives a conventional sound system 11. Thus the setting of each drawbar, by determining a coefficient value for one harmonic, controls the output waveform.

While the invention was described as a modification to the circuit described in U.S. Pat. No. 3,809,786, it is equally applicable to the circuit described in the above-identified copending application Ser. No. 603,796. The drawbar switches 104, 106, 109 are connected between the decoder 25 in FIG. 1 of the application and either or both of the harmonic coefficient memories 26 and 27 of the application in the same manner as described above in connection with decoder 102 and harmonic coefficient memory 15.

What is claimed is:

1. In a computer organ or the like in which individual tones are generated by calculating data corresponding to the amplitudes of a plurality of points of the waveform of a selected tone, the date being calculated by summing for each point the product of a stored coefficient value and a sinusoid value for each of a predetermined number of harmonics, apparatus for preselecting the tonal quality by selectively modifying the calculated data comprising: an addressable memory for storing at least one set of coefficient values, means for generating addresses in a predetermined sequence, and means coupling the address generating means to the memory for addressing and reading out a selected one of the coefficient values from the memory at a time, said means including switch means for preselectively changing the sequence in which the memory is addressed in response to the addressing means to change the sequence in which each of the coefficient values is read out of memory, whereby the coefficient values used in the calculation of the data may be selectively varied.

2. Apparatus of claim 1 wherein the switch means includes a plurality of manually settable multipole switches, each pole position of each switch corresponding to a predetermined address location in the coefficient memory, and means responsive to the address generating means for coupling an address signal to the memory through each switch in sequence, whereby the coefficients are read out of memory in sequence from the addresses determined by the respective pole setting of the switches.

3. Apparatus of claim 2 wherein the respective switches are drawbar switches.

4. Apparatus of claim 2 wherein the address generating means includes a counter.

5. Apparatus of claim 2 wherein the coefficient values are stored in digitally coded form in the addressable memory.

6. In a tone synthesizer in which sounds are produced by converting a set of data indicative of the relative amplitudes of a series of points defining the waveform of a musical tone to an analog signal varying in proportion to the sequence of values in said data set as a function of time, each value in said data set being generated by multiplying for each point a sinusoid value for each harmonic with a coefficient value for that harmonic and summing the resultant values for all harmonics, apparatus comprising: an addressable memory for storing a plurality of coefficient values for use in generating the set of data, and means for addressing and reading out the coefficient values sequentially from the memory, including a plurality of multipole switches, each switch being associated with one harmonic, each switch selectively addressing any one of a plurality of coefficient values in the memory depending on the setting of the switch, and means for coupling an address signal to the memory through each switch in sequence, whereby the particular coefficient values in the sequence of values read out of the memory is determined by the respective setting of said switches.

* * * * *